US009267092B2

(12) United States Patent
Wilkes

(10) Patent No.: US 9,267,092 B2
(45) Date of Patent: Feb. 23, 2016

(54) MOTORCYCLE ENGINE LUBRICANT

(75) Inventor: Mark F. Wilkes, Burton-upon-Trent (GB)

(73) Assignee: The Lubrizol Corporation, Wickliffe, OH (US)

( * ) Notice: Subject to any disclaimer, the term of this patent is extended or adjusted under 35 U.S.C. 154(b) by 91 days.

(21) Appl. No.: 14/113,475

(22) PCT Filed: Apr. 25, 2012

(86) PCT No.: PCT/US2012/034862

§ 371 (c)(1),
(2), (4) Date: Nov. 8, 2013

(87) PCT Pub. No.: WO2012/151084

PCT Pub. Date: Nov. 8, 2012

(65) Prior Publication Data

US 2014/0051617 A1 Feb. 20, 2014

Related U.S. Application Data

(60) Provisional application No. 61/482,244, filed on May 4, 2011.

(51) Int. Cl.

| | |
|---|---|
| ***C10M 133/46*** | (2006.01) |
| ***C10M 133/44*** | (2006.01) |
| ***C10M 163/00*** | (2006.01) |

(52) U.S. Cl.

CPC ..... *C10M 133/46* (2013.01); *C10M 133/44* (2013.01); *C10M 163/00* (2013.01); *C10M 2203/1025* (2013.01); *C10M 2205/022* (2013.01); *C10M 2205/0285* (2013.01); *C10M 2207/026* (2013.01); *C10M 2207/028* (2013.01); *C10M 2209/084* (2013.01); *C10M 2215/064* (2013.01); *C10M 2215/223* (2013.01); *C10M 2215/224* (2013.01); *C10M 2215/28* (2013.01); *C10M 2219/046* (2013.01); *C10M 2223/045* (2013.01); *C10N 2230/06* (2013.01); *C10N 2240/104* (2013.01)

(58) Field of Classification Search

CPC ..... C10N 2230/06; C10N 2240/104; C10N 2240/105; C10N 2240/106; C10M 133/44; C10M 133/46; C10M 2215/224

USPC ..... 508/283

See application file for complete search history.

(56) References Cited

U.S. PATENT DOCUMENTS

| | | | | |
|---|---|---|---|---|
| 4,661,271 | A | 4/1987 | Horodysky et al. | |
| 4,909,952 | A | 3/1990 | Salomon et al. | |
| 5,344,579 | A | 9/1994 | Ohtani et al. | |
| 6,103,673 | A | 8/2000 | Sumiejski et al. | |
| 6,451,745 | B1 | 9/2002 | Ward | |
| 6,525,004 | B1 * | 2/2003 | Hartley et al. | 508/188 |
| 6,610,634 | B1 * | 8/2003 | Tiffany et al. | 508/110 |
| 7,414,014 | B2 * | 8/2008 | Natoli et al. | 508/459 |
| 7,932,218 | B2 * | 4/2011 | Chasan et al. | 508/262 |
| 8,268,761 | B2 * | 9/2012 | Suen et al. | 508/284 |
| 8,962,539 | B2 * | 2/2015 | Devlin et al. | 508/283 |
| 2006/0287202 | A1 * | 12/2006 | Waddoups et al. | 508/287 |
| 2007/0293406 | A1 * | 12/2007 | Henly et al. | 508/185 |
| 2008/0051306 | A1 | 2/2008 | Chasan et al. | |
| 2008/0096778 | A1 | 4/2008 | Breon et al. | |
| 2008/0119378 | A1 * | 5/2008 | Gandon et al. | 508/390 |
| 2008/0280795 | A1 | 11/2008 | Fujitsu et al. | |
| 2009/0305922 | A1 * | 12/2009 | Cha et al. | 508/186 |
| 2010/0041572 | A1 | 2/2010 | Sano et al. | |
| 2011/0030269 | A1 * | 2/2011 | Chasan et al. | 44/388 |
| 2013/0005621 | A1 * | 1/2013 | Delbridge et al. | 508/189 |

OTHER PUBLICATIONS

Written Opinion of Corresponding Application No. PCT/US2012/034862 dated Apr. 25, 2012.

Corresponding International Publication No. WO2012/151084 A1 published Nov. 8, 2012.

Search Report of Corresponding Application No. PCT/US2012/034862 dated Apr. 25, 2012.

* cited by examiner

*Primary Examiner* — Ellen McAvoy

(74) *Attorney, Agent, or Firm* — David M. Shold; Teresan W. Gilbert

(57) ABSTRACT

A motorcycle having an engine and a clutch may be lubricated by supplying to the engine, but not to the clutch a lubricant of an oil of lubricating viscosity, an overbased detergent, a dispersant, a metal salt of a phosphorus acid, and a hydroxyalkyl-substituted imidazoline having a hydrocarbyl substituent of at least about 8 carbon atoms and a hydroxyalkyl substituent having 2 to 8 carbon atoms.

11 Claims, No Drawings

MOTORCYCLE ENGINE LUBRICANT

BACKGROUND OF THE INVENTION

The disclosed technology relates to a lubricant suitable for a motorcycle that does not have a clutch lubricated by the same lubricant, e.g., with non-lubricated ("dry") clutch plates.

Lubricants for motorcycles typically provide lubrication for the engine (a crankcase) and a wet clutch. These two devices, although often lubricated by the same fluid, often have different lubrication requirements. For example, the lubrication of the engine desirably provides low metal-on-metal friction, to promote good fuel economy. (Typically, the "metal" referred to is steel.) However, the friction coefficient for the metal-on-composition interfaces located within the wet clutch is typically desired to be relatively high, to assure good engagement and power transmission. Additionally, motorcycle lubricants will also lubricate other devices such as gears or bearings, each having their own lubricating requirement. Many lubricants have been designed over the year for lubrication of motorcycles (also known as motorbikes or motorscooters). One such lubricant is described in U.S. Patent Publication 2008-0096778, Breon et al., Apr. 24, 2008.

Because of the varied and demanding lubrication performance required of them, motorcycle lubricants are typically designed specifically for use in motorcycles. That is, typical lubricants as used in lubricating passenger car engines are not normally used for motorcycles. Such lubricants may exhibit a low coefficient of friction that is undesirable for lubricating the wet clutch found in most motorcycles. The two types of lubricant technologies have, simply put, diverged in recent years.

Nevertheless, there are a certain number of motorcycles which do not employ a wet clutch, but, rather, "dry" or non-lubricated clutches or clutch plates. (Likewise there might be motorcycles for which a wet clutch is lubricated by a separate lubricants from that used to lubricate the engine.) For those motorcycles, the high metal-on-composition friction is of no benefit to the engine and is indeed undesirable to the extent that it may interfere with the provision of the lowest possible friction in the metal-on-metal interfaces. While one possible approach to solving this problem would be to remove from the lubricant those components that provide high metal-on-composition friction, this is not necessarily desirable. The additives within such lubricants are usually carefully balanced, so that the removal of one component may affect the performance of the lubricant in unintended ways. Furthermore, it may be undesirable, from a commercial standpoint, to stock multiple complete motorcycle lubricants: some for motorcycles with a wet clutch, and some for motorcycles with a dry clutch.

Various friction-reducing additives are known. Glycerol monooleate ("GMO") is a well-known friction modifier for engines as disclosed in, e.g., U.S. Patent Publication 2008-0280795, Fujitsu, Nov. 13, 2008. However, GMO does not appear to be particularly effective in the present application. Various molybdenum compounds are also known as friction modifiers, as disclosed in, the aforementioned US 2008-0280795. However, Mo compounds are relatively expensive and thus may be impractical at the concentrations that may be required to achieve the desired effect in the present application.

Various materials are known as friction modifiers or friction stabilizers in the context of lubrication of automatic transmissions, that is, devices that do involve lubrication of a wet clutch. U.S. Pat. No. 5,344,579, Ohtani et al., Sep. 6, 1994, discloses a friction modifier system with the capability of establishing and maintaining a substantially constant static breakaway coefficient of friction between a pair of friction surfaces. The additive the composition comprises (a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms, and (b) a di(hydroxyalkyl) aliphatic tertiary amine. A particularly preferred compound is said to be 1-hydroxyethyl-2-heptadecenyl imidazoline.

U.S. Patent Publication 2008/0051306, Chasan et al., Feb. 28, 2008, discloses a lubricant composition containing sterically hindered amine compounds as antioxidants. The lubricants disclosed are said to be functional fluids, that is, lubricants, hydraulic fluids, or metal working fluids. The antioxidants are said to be of particular importance, in that, for instance, oxidative degradation of lubricants plays a significant role especially in motor oils because of the high temperature prevailing in the combustion chamber of the engines. Various other additives may be present, including, for instance, as examples of rust inhibiters and friction modifiers: nitrogen-containing compounds, for example: heterocyclic compounds, for example: 2-heptadecenyl-1-(2-hydroxyethyl)imidazoline.

The disclosed technology, therefore, solves the above problems by providing a top-treatment of an additive which can effectively convert a traditional motorcycle lubricant into one having improved (reduced) metal-on-metal friction and resulting improved fuel economy. The top-treatment may be added by the consumer, by a retailer, or by the manufacturer. The resulting lubricant provides a desired reduction in friction coefficient which is typically reflected by an increase in fuel economy. The disclosed technology may also be used to lubricate internal combustion engines generally (that is, not exclusively motorcycle engines).

SUMMARY OF THE INVENTION

A method for lubricating a motorcycle having an engine and clutch plates, comprising supplying to the engine thereof, but not to the clutch plates, a lubricant comprising (a) an oil of lubricating viscosity; (b) an overbased detergent; (c) a dispersant; (d) a metal salt of a phosphorus acid; and (e) a hydroxy-alkyl-substituted imidazoline having a hydrocarbyl substituent of at least 8 carbon atoms, wherein the hydroxyalkyl substituent comprises 2 to 8 carbon atoms.

DETAILED DESCRIPTION OF THE INVENTION

Various preferred features and embodiments will be described below by way of non-limiting illustration.

The fully formulated lubricant (including the component(s) that may be added as a top-treat or may be included by the manufacturer) will include, as one component, an oil of lubricating viscosity, also referred to as a base oil. The base oil may be selected from any of the base oils in Groups I-V of the American Petroleum Institute (API) Base Oil Interchangeability Guidelines, namely

| Base Oil Category | Sulfur (%) | | Saturates(%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and sol-vent-treated or acid treated mineral lubricating oils of the paraffinic, naphthenic, or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 mono-carboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils. Yet other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined, and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The composition of the present invention will also contain one or more detergents. Detergents are typically overbased materials, otherwise referred to as overbased or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis. Some useful detergents may have a TBN of 100 to 800, or 150 to 750, or, 400 to 700. In certain embodiments, the detergent may have a relatively lower TBN, such as 70-270, 140-250, or 180-220.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T-$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. A general example of such a saligenin derivative can be represented by the formula

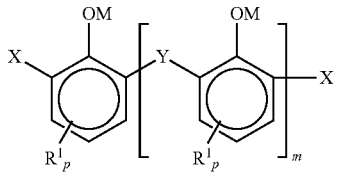

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R_1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (I) or formula (II):

(I)

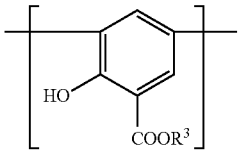

(II)

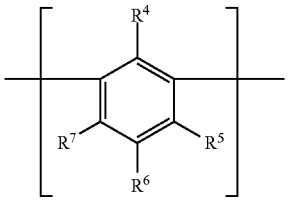

each end of the compound having a terminal group of formula (III) or (IV):

(III)

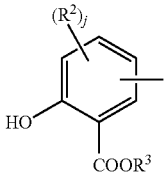

(IV)

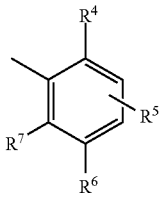

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

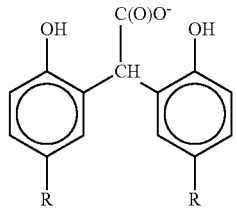

wherein each R is independently an alkyl group containing at least 4 or 8 carbon atoms, provided that the total number of carbon atoms in all such R groups is at least 12 or 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate, e,g., an alkali metal or alkaline earth metal salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased detergent, in the formulations of the present technology, is typically at least 0.6 weight percent on an oil-free basis, or 0.7 to 5 weight percent or 1 to 3 weight percent. Either a single detergent or multiple detergents can be present.

Another component in the present compositions is a dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

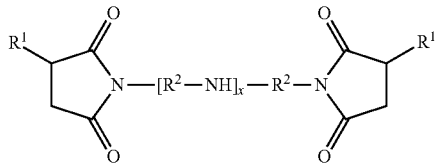

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

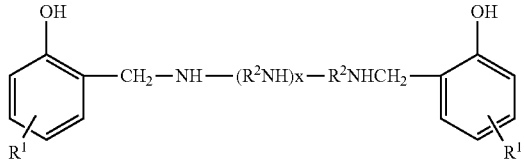

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant of the present technology may be at least 0.1% of the lubricant composition, or at least 0.3% or 0.5% or 1%, and in certain embodiments at most 9% or 8% or 6% or 4% or 3% or 2% by weight.

The lubricant will also contain a metal salt of a phosphorus acid. Metal salts of the formula

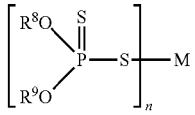

wherein $R^8$ and $R^9$ are independently hydrocarbyl groups containing 3 to 30 or to 20, to 16, or to 14 carbon atoms well known and are readily obtainable by the reaction of phosphorus pentasulfide ($P_2S_5$) and an alcohol or phenol to form an O,O-dihydrocarbyl phosphorodithioic acid corresponding to the formula

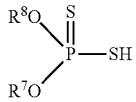

The reaction involves mixing, at a temperature of 20° C. to 200° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is aluminum, lead, tin, manganese, cobalt, nickel, zinc, or copper, and most preferably zinc. The basic metal compound is thus preferably zinc oxide, and the resulting metal compound is represented by the formula

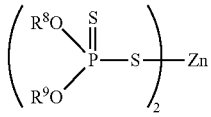

The $R^8$ and $R^9$ groups are independently hydrocarbyl groups that are typically free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethyl-hexanol and 2-propanol or, alternatively, a mixture of secondary alcohols such as 2-propanol and 4-methyl-2-pentanol.

Such zinc salts are often referred to as zinc dialkyldithiophosphates or simply zinc dithiophosphates. They are well known and readily available to those skilled in the art of lubricant formulation. In certain embodiments, the zinc dialkyldithiophosphate may have $R^8$ and $R^9$ groups selected to reduce phosphorus volatility from the lubricant, that is, to increase retention of phosphorus in the lubricant. Suitable formulations to provide good phosphorus retention in an engine are disclosed, for instance, in US published application 2008-0015129, see, e.g., claims.

The amount of the metal salt of a phosphorus acid in a completely formulated lubricant, if present, will typically be 0.1 to 4 percent by weight, and in some embodiments 0.5 to 2 percent by weight or 0.75 to 1.25 percent by weight. Its concentration in a concentrate will be correspondingly increased, to, e.g., 5 to 20 weight percent.

The present technology also contains a hydroxyalkyl-substituted imidazoline having a hydrocarbyl substituent of at least about 8 carbon atoms, wherein the hydroxyalkyl substituent comprises 2 to about 8 carbon atoms. This class of materials may be effective at reducing the metal-on-metal friction coefficient in lubricants containing the aforementioned components.

The amount of the substituted imidazoline will be an amount suitable to measurably reduce the metal-on-metal coefficient of friction. Such amounts may typically be 0.01 to 5 percent by weight, or 0.025 to 2.5, or 0.05 to 2, or 0.1 to 1, or 0.2 to 0.7 percent by weight.

Imidazolines in general may be prepared by known methods, such as by the condensation of a carboxylic acid, R(O)OH or reactive equivalent thereof, with a diamine or polyamine. In the case of a hydroxyalkylimidazoline, the amine in question may be of a structure such as HO—$CH_2CH_2NHCH_2CH_2NH_2$, although there may be considerable variation in such a structure, including in the specific alkylene group to which the hydroxy group is attached.

The imidazoline compound may comprise a 1-(hydroxyalkyl)-2-(hydrocarbyl)imidazoline, which may be more specifically a 1-(2-hydroxyethyl)-2-(C8 to C24 aliphatic hydrocarbyl)imidazoline, which may be represented by the general formula

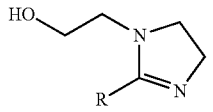

wherein R is a branched or unbranched, saturated or unsaturated aliphatic hydrocarbon group of 8 to 24 carbon atoms.

Alternatively, in certain embodiments the R group shown on the imidazoline ring above may be a hydrocarbyl group which may have one or more oxygen atoms. For instance, the hydrocarbyl group may contain an ether linkage, or a hydroxyl substituent, or a carbonyl group, e.g., as a ketone or as part of an ester linkage (either —OC(O)— or —C(O)O—). An example would be an imidazoline compound prepared by condensation of a hydroxystearic acid, e.g., 12-hydroxystearic acid.

Moreover, in certain embodiments there may be more than one hydrocarbyl group on the imidazoline ring as well as optionally other variations as described below. Such a material may be represented generally by the structure

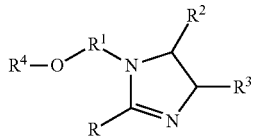

where R is as described above and $R^1$ is an alkylene group of 2 to 8 carbon atoms. $R^2$ and $R^3$ are each independently hydrogen or hydrocarbyl groups of 1 to 24 carbon atoms (in some embodiments one of them may be a methyl group), or $R^2$ and $R^3$ may be joined together form a cyclic structure. Alternatively, R, $R^2$, and $R^3$ may be attached to other carbon atoms on the imidazoline ring than those shown, thus representing different isomers. $R^4$ may be a hydrogen atom or a hydrocarbyl group of 2 to 8 carbon atoms or a hydrocarbyl group of 2 to 8 carbon atoms interrupted by 1, 2, or 3 oxygen or nitrogen atoms (e.g., an ether-, poly-ether-, amine-, polyamine-, or ether-amine-containing group). Such materials could be prepared by condensing a carboxylic acid with the appropriately substituted diamine or polyamine.

Thus, in one embodiment, the present technology provides a lubricant comprising (a) an oil of lubricating viscosity, (b) an overbased detergent, (c) a dispersant, (d) a metal salt of a phosphorus acid, and (e) an alkoxyalkyl-substituted imidazoline having a hydrocarbyl substituent of at least 8 carbon atoms, wherein the alkoxyalkyl substituent comprises 3 to 9 carbon atoms (e.g., at least 2 carbon atoms in the alkyl portion thereof and up to 7 carbon atoms in the alkoxy portion thereof).

In one embodiment, the imidazoline may be represented by the following formula, with suggested nomenclatures shown:

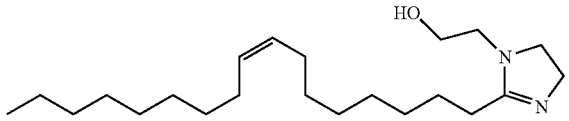

1-(Hydroxyethyl)-2-(heptadecenyl)imidazoline 1-(Hydroxyethyl)-2-(8-heptadecenyl)imidazoline 1H-Imidazole-1-ethanol, 2-(8-heptadecen-1-yl)-4,5-dihydroalthough it is to be understood that the commercially available materials may be mixtures of various isomers and, in particular, the long hydrocarbyl chain may include significant variations from that shown. In particular, the double bond within the hydrocarbyl chain may be located in a different position or may be absent entirely; it may be cis or trans; or there may be more than one double bond at various locations. The carbon chain may likewise be branched. The detailed nature of the hydrocarbyl chain may reflect the structure of the fatty acid from which the imidazoline may be prepared. For instance, if the imidazoline is prepared from oleic acid, the double bond will typically be at or near the 8-position in the hydrocarbyl chain, as shown. Other acids, such as stearic acid, are fully saturated. Moreover, other components than the shown imidazoline structure shown may be present. Such materials may include the amide (non-cyclized), oxazoline, or ester condensation products.

The lubricant will typically contain, or may alternatively exclude, any of the additional additives that are commonly found in engine lubricants such as motorcycle engine lubricants.

One such additive is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylamino-propyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ 7308, and 7318 from Lubrizol); styrene/maleate ester copolymers, which are dispersant copolymers (such as LZ 3702 and 3715 from Lubrizol); polymethacrylates, some of which have dispersant properties (such as those in the Viscoplex™ series from RohMax, the Hitec™ series of viscosity index improvers from Afton, and LZ 7702, LZ® 7727, LZ® 7725 and LZ 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12% or 3 to 10% by weight may be used.

As used in this document, expressions such as "represented by the formula" indicate that the formula presented is generally representative of the structure of the chemical in question. However, minor variations can occur, such as positional isomerization. Such variations are intended to be encompassed.

Another component may be an antioxidant. Antioxidants encompass phenolic antioxidants, which may be hindered phenolic antioxidants, onr or both orthopositions on a phenolic ring being occupied by bulky groups such as t-butyl. The para position may also be occupied by a hydrocarbyl group or a group bridging two aromatic rings. In certain embodiments the para position is occupied by an ester-containing group, such as, for example, an antioxidant of the formula

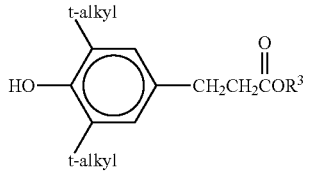

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines. In one embodiment, an aromatic amine antioxidant can comprise an alkylated diphenylamine such as nonylated diphenylamine or a mixture of a di-nonylated and a mono-nonylated diphenylamine.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as anti-wear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Titanium compounds may also be antioxidants. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Another additive is an anti-wear agent, which may be used in addition to the metal salt of a phosphorus acid, described above. Examples of anti-wear agents include phosphorus-containing anti-wear/extreme pressure agents such as metal thiophosphates, phosphoric acid esters and salts thereof, phosphorus-containing carboxylic acids, esters, ethers, and amides; and phosphites. In certain embodiments a phosphorus anti-wear agent may be present in an amount to deliver 0.01 to 0.2 or 0.015 to 0.15 or 0.02 to 0.1 or 0.025 to 0.08 percent phosphorus. Often the anti-wear agent is a zinc dialkyldithiophosphate (ZDP). For a typical ZDP, which may contain 11 percent P (calculated on an oil free basis), suitable amounts may include 0.09 to 0.82 percent. Non-phosphorus-containing anti-wear agents include borate esters (including borated epoxides), dithiocarbamate compounds, molybdenum-containing compounds, and sulfurized olefins.

Other types of anti-wear agents include tartrate esters, tartramides, and tartrimides, such as oleyl tartrimide, as well as esters, amides, and imides of hydroxy-polycarboxylic acids in general. These materials may also impart additional functionality to a lubricant beyond anti-wear performance. These materials are described in greater detail in US Publication 2006-0079413 and PCT publication WO2010/077630.

Other additives that may optionally be used in lubricating oils include pour point depressing agents, extreme pressure agents, anti-wear agents, color stabilizers, and anti-foam agents.

Another component that may be used in the present technology is a supplemental friction modifier, beside those discussed above. These friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty amides | metal salts of fatty acids |
| fatty epoxides | sulfurized olefins |
| borated fatty epoxides | fatty imidazolines |
| fatty amines | molybdenum compounds |
| glycerol esters | metal salts of alkyl salicylates |
| borated glycerol esters | amine salts of alkylphosphoric acids |

-continued

| | |
|---|---|
| alkoxylated fatty amines | ethoxylated alcohols |
| oxazolines | polyhydroxy tertiary amines |
| hydroxyalkyl amides | dialkyl tartrates |

condensation products of carboxylic acids and polyalkylene-polyamines and mixtures of two or more thereof.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used in this document, expressions such as "represented by the formula" indicate that the formula presented is generally representative of the structure of the chemical in question. However, minor variations can occur, such as positional isomerization. Such variations are intended to be included.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While the lubricant as described herein is suitable for use in motorcycle engine with a dry clutch (or with a separately lubricated wet clutch), it may be more generally used in other engines. In one embodiment the internal combustion engine may have a common oil reservoir supplying the same lubricating composition to the crankcase and at least one gear or gears, which may be in a gearbox (transmission). In one embodiment the internal combustion engine is a 4-stroke engine. In one embodiment the internal combustion engine is also referred to generically as a small engine. The small engine, in one embodiment, may have a power output of 2.2 to 19 kW (3 to 25 horsepower (hp)), in another embodiment 3.0 to 4.5 kW (4 to 6 hp). Examples of small engines include those in home/garden tools such as lawnmowers, hedge trimmers, chainsaws, snow blowers, or roto-tillers. In one embodiment the internal combustion engine has a capacity of up to 3500 $cm^3$ displacement, in another embodiment up to 2500 $cm^3$ displacement and in another embodiment up to 2000 $cm^3$ displacement, and in another embodiment exhibits 100 to 200 $cm^3$ displacement. Examples of suitable internal combustion engines with a capacity up to 2500 $cm^3$ displacement include motorcycle, snowmobile, jet-ski, quad-bike, and all-terrain vehicle engines. It may be used in engines fueled by gasoline, alcohols, gasoline-alcohol mixtures, diesel fuel, biodiesel fuel, or hydrogen, and in spark-ignited or compression-ignited engines. It may also be used in automotive engines, heavy duty diesel engines, marine diesel engines, and stationary gas engines.

EXAMPLES

Reference Formulation A is prepared in a poly-alpha-olefin base oil, formulated by balancing of PAO components, a viscosity modifier, and a pour point depressant to provide an S.A.E. 40 weight fluid. In addition, a dispersant-inhibitor ("DI") package, providing the following additional components:

3.9% succinimide dispersant (including 47% diluent oil)
1.1% overbased calcium sulfonate and phenate detergents (44% oil)
1.2% zinc dialkyldithiophosphate (9% oil)
1.0% aminic and hindered phenol ester antioxidants
100 ppm commercial antifoam agent
0.14% additional diluent oil

Example 1

Reference Formulation A, top-treated by adding 0.5% of 1-hydroxyethyl-2-(heptadecenyl)imidazoline.

Example 2

A separate formulation is prepared which is similar to Reference Formulation A: however, it is prepared in a Group II mineral oil; and the DI package comprises 3.9% succinimide dispersant (50% oil), 2.9% overbased Ca and Na phenate and sulfonate detergents (27-42% oil), 1.0% zinc dialkyldithiophosphate (9% oil), 0.25% aminic antioxidant, 140 ppm commercial antifoam agent, and a small amount of additional diluent oil. The formulation is top-treated by adding 0.5% of 1-hydroxyethyl-2-(heptadecenyl)imidazoline.

Untreated Reference Formulation A and the treated materials of Examples 1 and 2 are tested for fuel economy in a Honda SH125i Scooter engine mounted on a test stand. Fuel is supplied by a pressure-controlled fuel container, and consumption is measured using a Bronckhorst™ Coriolis meter. The fuel economy test cycle consists of an initial no-load stage, followed by 13 cycles of 10 minutes steady state operation at engine speeds of 5800 to 8600 r.p.m. and loads varying from about 2.8 to about 10.3 Nm. Fuel consumption is measured on 5 repeats of the 13-stage test cycle after one initial 13-stage cycle run for stabilization purposes.

The results of the fuel consumption test show that Example 1 exhibits a 1.33 percent fuel economy benefit compared with Reference Formulation A, and Example 2 similarly exhibits a 1.36 percent fuel economy benefit compared with Reference Formulation A. The presence of 1-hydroxyethyl-2-(heptadecenyl)imidazoline will lead to improved fuel economy when used with a variety of different additive package formulations.

A lubricant formulation (Reference Formulation C) is prepared containing the following components:

Mineral base oil–balance to =100%

12.4% Ethylene/propylene copolymer viscosity modifier, including 87% oil
0.2% Pour point depressant, polymethacrylate, including 25% oil
4.60% Succinimide dispersant, including 47% oil
0.98% Antioxidants (aminic and hindered phenol ester)
0.84% Zinc dialkyldithiophosphate, including 9% oil
1.84% Overbased calcium phenate and sulfonate detergents, including 41% oil
0.01% Commercial antifoam agent Reference Formulation C is top-treated with 1-hydroxyethyl-2-(hepta-decenyl)imidazoline ("HHI") in the amounts shown in the table below. The top-treated lubricants are subjected to the SAE#2 test for measurement of friction properties as specified by JASO T904. The properties measured are Dynamic Friction Index (DFI), Static Friction Index (DFI), and Stop Time Index (STI). Each of these is measured in a test which simulates a lubricated clutch; in order to achieve a desired JASO MB rating for motorcycle engines without wet clutch, at least one of the measured values should be within the indicated ranges (indicating generally lower friction desired for a dry-clutch engine). DFI is a measure of "clutch feel" and of progressive power transfer under slipping conditions of a lubricated clutch. SFI is a measure of closed clutch torque handling capacity: the resistance of a lubricated clutch to slippage under high torque breakaway conditions. STI is a measure of how quickly the lubricated clutch engages.

| Example | % HHI | DFI | SFI | STI |
|---|---|---|---|---|
| 3 | 0.25 | 1.5 | 1.11 | 1.5 |
| 4 | 0.50 | 1.77 | 0.86 | 1.67 |
| JASO MB limits | | ≥0.5, <1.45 | ≥0.5, <1.15 | ≥0.5, <1.55 |

The formulation of Example 3 meets 2 of the JASO MB limits and thus qualifies under JASO MB standards. The formulation of Example 4 meets 1 of the JASO MB limits and thus qualifies under JASO MB standards. In the absence of the added HHI friction modifier, the DFI, SFI, and STI values typically will each be greater than the listed upper limits for MB standard.

Examples 5 through 10

Lubricant formulations similar to those of Reference Formulation C are prepared, containing the following amounts of the following imidazoline materials:

| Example | Imidazoline type | Amount, % |
|---|---|---|
| 5 | 1-hydroxyethyl-2-(8-heptadecenyl)imidazoline | 0.025 |
| 6 | 1-hydroxyethyl-2-(8-heptadecenyl)imidazoline | 2.5 |
| 7 | 1-hydroxyethyl-2-(heptadecyl)imidazoline | 0.8 |

-continued

| Example | Imidazoline type | Amount, % |
|---|---|---|
| 8 | 1-hydroxyethyl-2-(tridecenyl)imidazoline | 0.5 |
| 9 | 1-hydroxyethyl-2-(trieicosyl)imidazoline | 0.3 |
| 10 | 1-hydroxybutyl-2-(heptadecenyl)imidazoline | 0.5 |

The formulations will provide reduced friction.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a motorcycle having an engine and a clutch and having a displacement of greater than 200 and up to about 3500 $cm^3$, comprising supplying to the engine thereof, but not to the clutch, a lubricant comprising (a) an oil of lubricating viscosity
(b) an overbased detergent
(c) a dispersant
(d) 0.1 to 2 percent by weight of a metal salt of a phosphorus acid and (e) 0.1 to 2 percent by weight of a hydroxyalkyl-substituted imidazoline consisting of a material of the structure

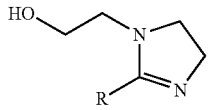

where R is a hydrocarbyl substituent of at least about 8 carbon atoms.

2. The method of claim 1 wherein R is a branched or unbranched, saturated or unsaturated aliphatic hydrocarbon group of 8 to about 24 carbon atoms.

3. The method of claim 1 wherein the hydroxyalkyl-substituted imidazoline is represented by the formula

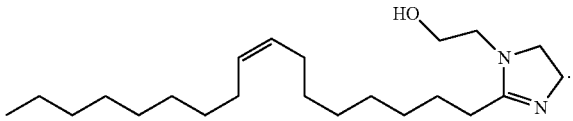

4. The method of claim 1 wherein the overbased detergent comprises an overbased calcium sulfonate detergent.

5. The method of claim 1 wherein the overbased detergent is present in an amount of about 0.6 to about 5 percent by weight.

6. The method of claim 1 wherein the dispersant comprises a succinimide dispersant.

7. The method of claim 1 wherein the dispersant is present in an amount of about 0.3 to about 6 percent by weight.

8. The method of claim 1 wherein the metal salt of a phosphorus acid comprises a zinc dialkyldithiophosphate.

9. The method of claim 1 wherein the motorcycle engine is a four-stroke cycle spark-ignited gasoline engine.

10. A method of lubricating an internal combustion engine, comprising supplying thereto the lubricant as described in claim 1.

11. The method of claim 1 wherein the dispersant (c) does not contribute sulfated ash to the lubricant.

* * * * *